United States Patent [19]

Eck

[11] 4,313,335

[45] Feb. 2, 1982

[54] VEHICLE WORK RACK STRUCTURE

[75] Inventor: Leonard F. Eck, McPherson, Kans.

[73] Assignee: Kansas Jack, Inc., McPherson, Kans.

[21] Appl. No.: 96,758

[22] Filed: Nov. 23, 1979

[51] Int. Cl.[3] ..... B21D 1/14; B66F 7/16; B66F 7/22

[52] U.S. Cl. ..... 72/457; 72/705; 187/8.47

[58] Field of Search ..... 72/705, 457; 187/8.41, 187/8.43, 8.49, 8.50, 8.47

[56] References Cited

U.S. PATENT DOCUMENTS

| | | | |
|---|---|---|---|
| 2,013,785 | 9/1935 | Merrill | 72/705 X |
| 2,422,030 | 6/1947 | Merrill | 72/705 X |
| 2,717,020 | 9/1955 | Dobias | 72/705 X |
| 3,088,547 | 5/1963 | MacMillan | 187/8.49 X |
| 3,269,169 | 8/1966 | Latuff et al. | 72/705 X |
| 3,338,083 | 8/1967 | Eck | 72/705 X |
| 3,377,834 | 4/1968 | Latuff et al. | 72/705 X |
| 3,776,022 | 12/1973 | Lionello | 72/705 X |
| 3,835,693 | 9/1974 | Majersky | 72/705 X |
| 3,888,100 | 6/1975 | Chisum | 72/705 X |
| 4,070,899 | 1/1978 | Venalainen | 72/705 X |
| 4,138,876 | 2/1979 | Chisum | 72/705 X |
| 4,151,737 | 5/1979 | Specktor | 72/705 X |
| 4,247,966 | 2/1981 | Labbe | 72/705 X |

FOREIGN PATENT DOCUMENTS

| | | | |
|---|---|---|---|
| 249933 | 10/1963 | Australia | 72/705 |

OTHER PUBLICATIONS

Applied Power, Inc. Automotive Service Systems, Bear Equip. for Body Frame and Axle Correction from 1973 Profil Guide Cat. pp. 3, 4, 6 & 7.

*Primary Examiner*—Lowell A. Larson
*Attorney, Agent, or Firm*—Fishburn, Gold and Litman

[57] ABSTRACT

A work rack structure for correcting and aligning misshapen vehicle frame and body portions comprises a rack structure having a vehicle supportive upper surface and a lower surface and with generally continuous front and rear end and opposite side rack portions having inner and outer marginal flanges and joined together to form a central interior opening whereby a vehicle straddles the opening for work access to the underside thereof. Front and rear supportive foot members are affixed to the rack structure for elevation above a floor surface, the rear supportive foot members being swingably mounted to the rack structure and having power fluid rams operatively connected thereto for folding the foot members and kneeling the rack structure to facilitate positioning of a vehicle thereon. A plurality of force applying members are affixed to the rack structure and are easily movable therearound so that they can be selectively positioned to exert force on substantially any part of the vehicle. The force applying members have locking pins for engagement with the rack structure and rollers which normally engage the inner and outer marginal flanges of the rack structure for translational movement thereon and when a pulling force is exerted by the force applying structure, the structure shifts upwardly relative to the rack structure and frictionally engages the inner and outer marginal flanges to prevent movement thereon.

7 Claims, 15 Drawing Figures

VEHICLE WORK RACK STRUCTURE

This invention relates to vehicle straightening and alignment structures and in particular to a work rack for use in alignment and straightening systems.

Work rack structures for correcting damaged, misaligned and misshapened vehicle frame and body parts often include a complex bridgework of vertical and horizontal beams which cause obstructions that interfere with access to the vehicle and particularly to the underside thereof. Such work racks are often associated with force applying units, power beams or the like which exert a force on a selective portion of the vehicle for correcting the improper condition and the force applying units are generally not easily movable or positionable relative to the work rack, making it difficult to exert a force in a desired direction. Moreover, the configuration of vehicle work racks typically requires that the vehicle be taken off the rack, turned around and repositioned on the rack for corrections to the opposite end thereof.

The objects of the present invention are: to provide a vehicle work rack which provides ease of access to any damaged area of the vehicle or to an area thereof to be worked upon; to provide such a work rack having a central interior opening without interfering beams or other obstructions thereacross and allowing easy access to the underside of the vehicle; to provide such a work rack having force applying members mounted thereon and which are movable completely around the work rack for exerting a force on any portion of the vehicle; to provide such a work rack with force applying members having sufficient work capacity to accomplish a variety of body and frame alignment tasks, to provide such a work rack having swingably mounted rear supportive foot members for kneeling the work rack to facilitate positioning of a vehicle thereon; to provide such a work rack which is easily adaptable for use with vehicle wheel alignment systems; to provide such a work rack having force applying members which are efficiently powered by power fluid rams for relatively rapid pulling action and to quickly correct improper conditions in vehicle frame and body parts; and to provide such a work rack which is efficient and sturdy in use, adaptable for a variety of uses, and suited for its intended purpose.

Other objects and advantages of this invention will become apparent from the following description taken in connection with the accompanying drawings wherein is set forth by way of illustration and example, a certain embodiment of this invention.

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
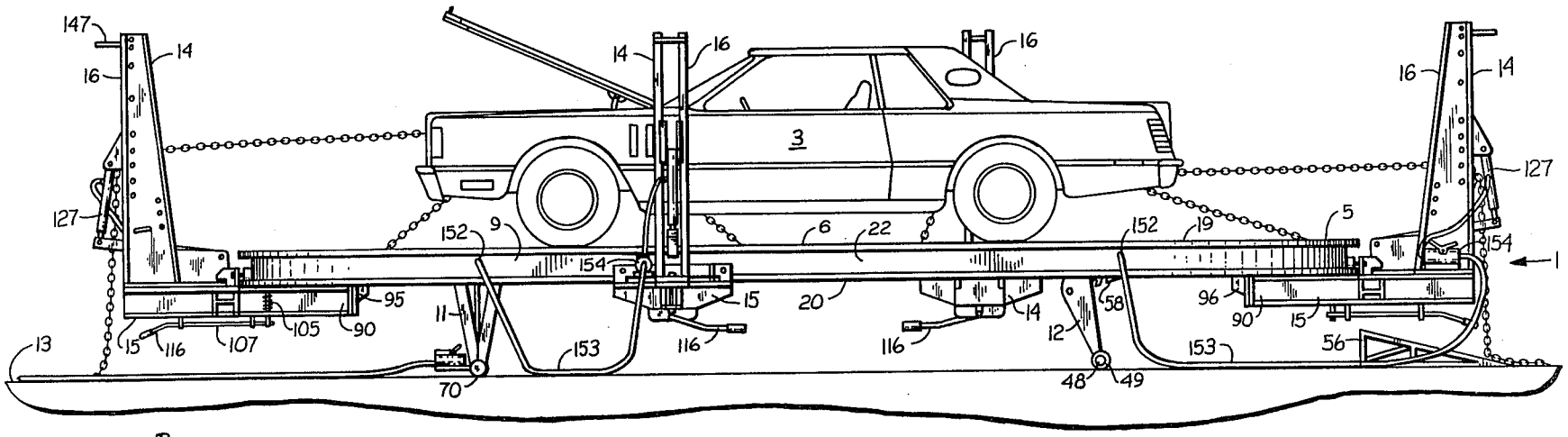
FIG. 1 is a side elevational view of a work rack embodying the present invention and shown with a vehicle positioned thereon and undergoing procedures for correction of damaged, misaligned or misshapened body and frame parts.

Referring more in detail to the drawings:

The reference numeral 1, FIG. 1, generally indicates a work rack embodying the present invention and used for correcting damaged, misshapened or misaligned vehicle frame and body parts. The work rack 1 includes a rack structure 2 having an upper surface adapted for supporting a vehicle 3 thereon and having generally continuous front and rear end rack portions 4 and 5 and opposite side rack portions 6 and 7. The rack structure 2 has inner and outer margins 8 and 9 joined together to form an interior opening 10 whereby the vehicle 3 straddles the opening to provide ease of work access to the underside thereof. Front and rear supportive foot members 11 and 12 are affixed to the rack structure 2 for elevation above a floor surface 13.

At least one force applying structure 14 is affixed to the rack structure 2 and has an elongate base 15 extending generally under one of the rack portions with means movably mounting the force applying structure 14 for selective translation and positioning around the outer margin 9 of the rack structure 2 whereby a force may be exerted on virtually any selected area of the vehicle 3.

The rack structure 2 includes means for locking the force applying structure 14 against translational movement at a selected location around the rack structure 2. A standard 16 is mounted on the elongate base 15 and is upstanding therefrom and a power means therein is adapted for operative connection to the vehicle 3 to exert a force thereon and correct misshapened frame and body portions.

In the illustrated example, the rack structure 2 is elongate and oval in shape when viewed from above, FIG. 3, or below, FIG. 5. The front and rear end rack portions 4 and 5 are generally semicircular in shape and the side rack portions 6 and 7 continuous therewith are generally straight and parallel in relationship whereby the interior opening 10 is situated between the front and rear end rack portions 4 and 5 and the side rack portions 6 and 7 and is likewise generally elongate and oval in shape. The rack structure 2 has planar upper and lower members 19 and 20 secured together by welding or the like in vertical spaced relation by inner and outer web members 21 and 22. The inner and outer margins 9 and 10 extend respectively inwardly and outwardly of the inner and outer web members 21 and 22 and the inner margin 8 has upper and lower flanges 23 and 24 and the outer margin 9 has upper and lower flanges 25 and 26 respectively extending from the planar upper and lower members 19 and 20. Further, the outer lower flange 26 has an upper surface 27 and an end surface 28 and the inner lower flange 24 likewise has an upper surface 29 and an end surface 30.

Figure 3:
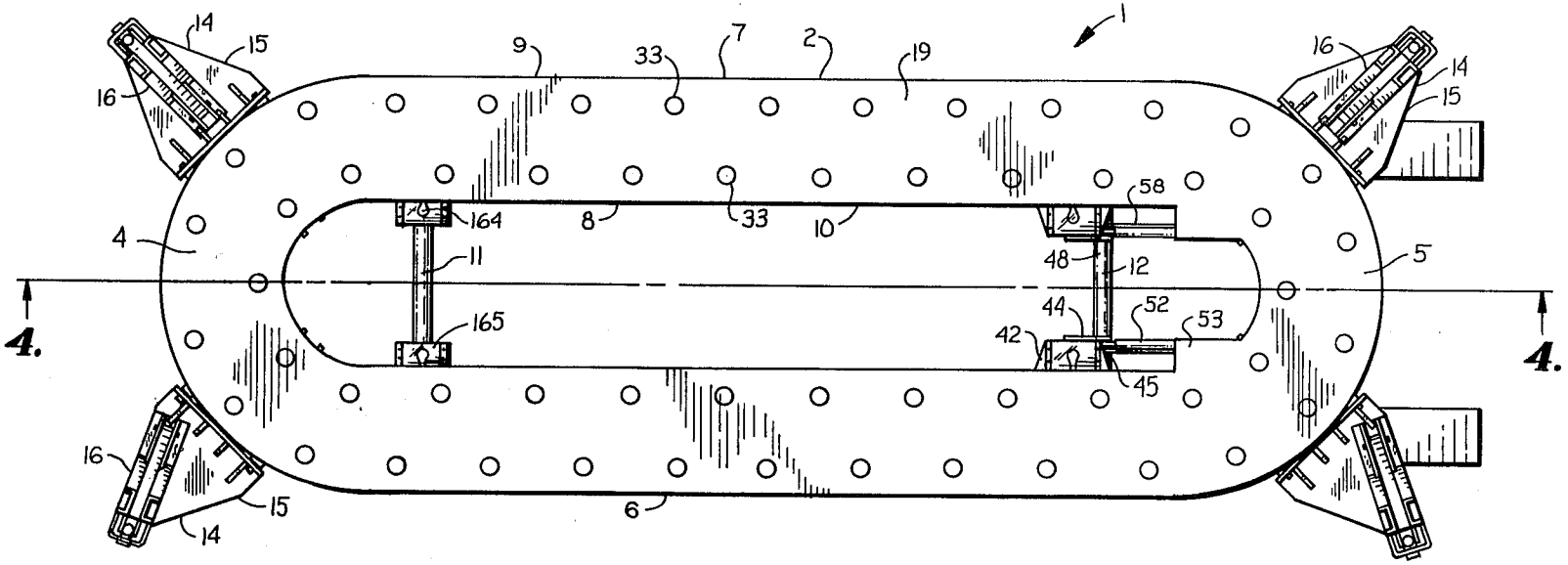
FIG. 3 is a plan view of the work rack and showing a plurality of force applying structures mounted thereon.
Figure 6:
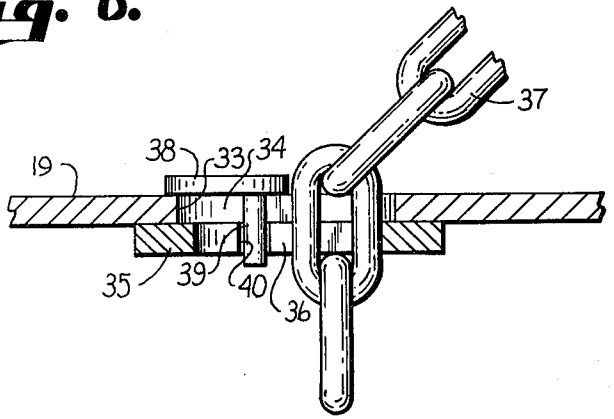
FIG. 6 is an enlarged, fragmentary, side view of a chain or anchor receptacle in the vehicle work rack.
Figure 7:
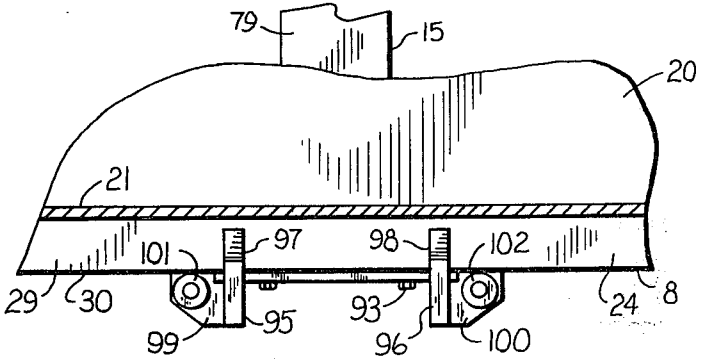
FIG. 7 is an enlarged, fragmentary view showing the engagement of a front portion of a force applying structure with an interior or opening margin in the work rack.
Figure 8:
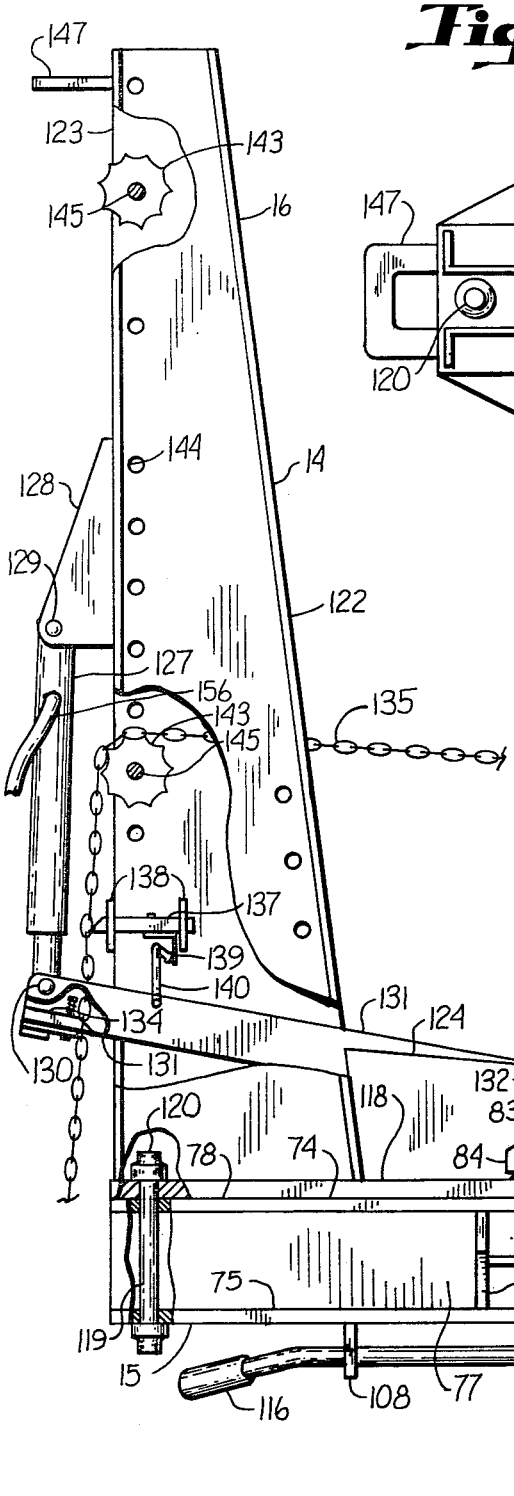
FIG. 8 is an enlarged, fragmentary view taken transversely through a section of the vehicle work rack and showing a force applying structure mounted thereon.
Figure 9:
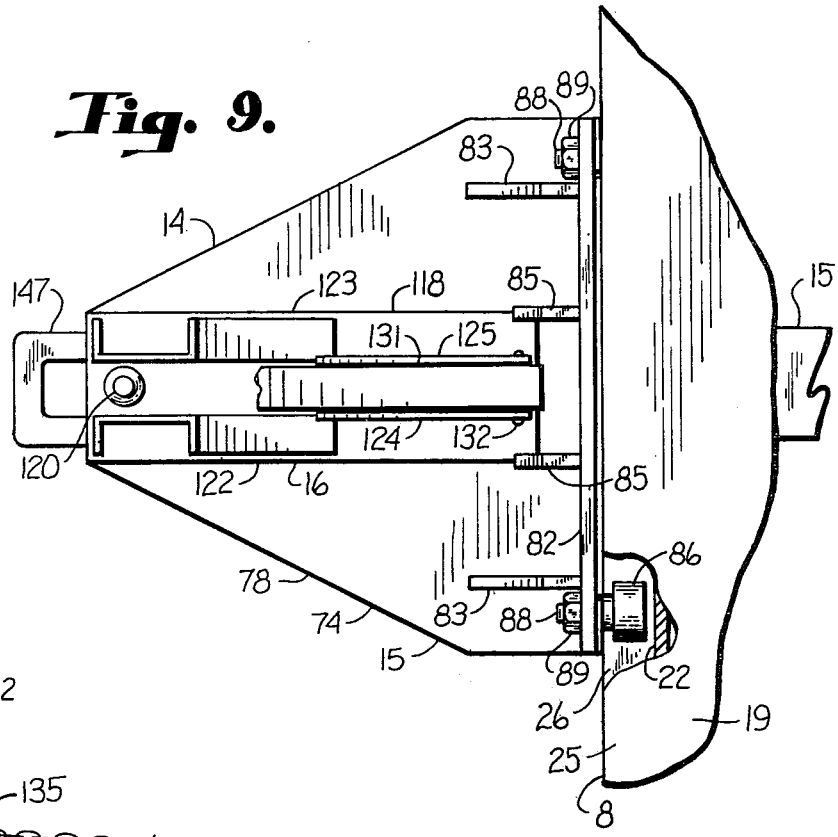
FIG. 9 is an enlarged, fragmentary view taken downwardly showing the connection between the rack structure and the force applying structure.
Figure 10:
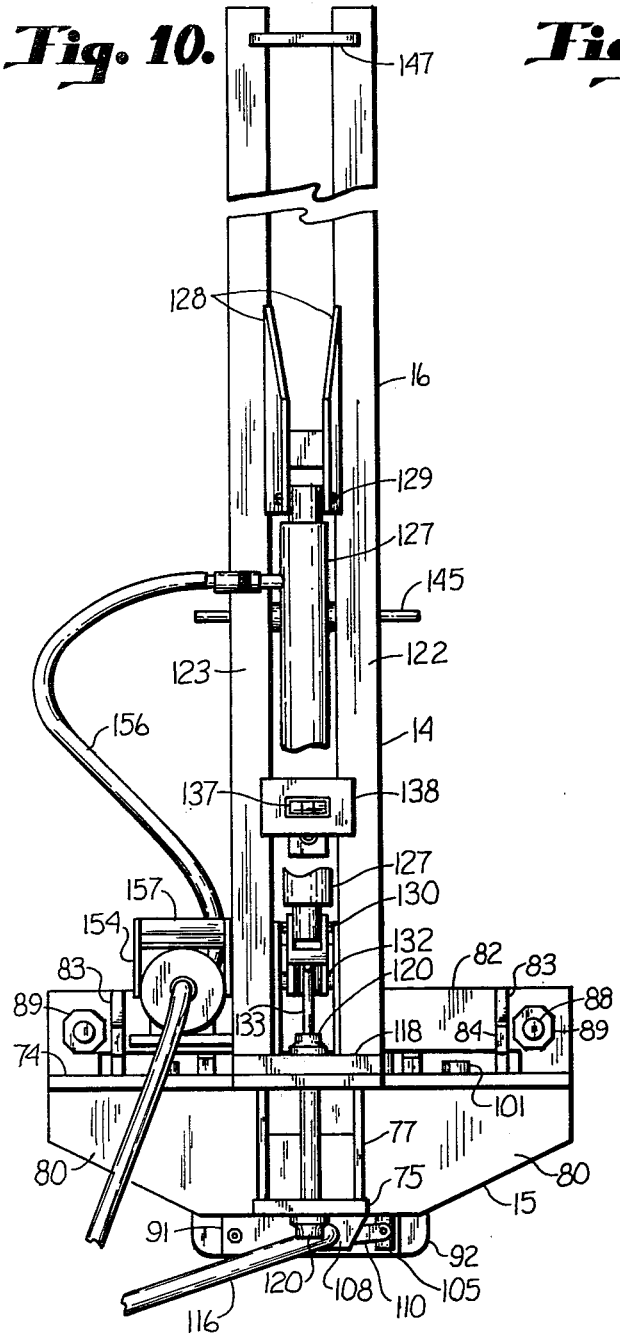
FIG. 10 is an enlarged, fragmentary view taken from the rear and showing the force applying structure of the work rack.
Figure 11:
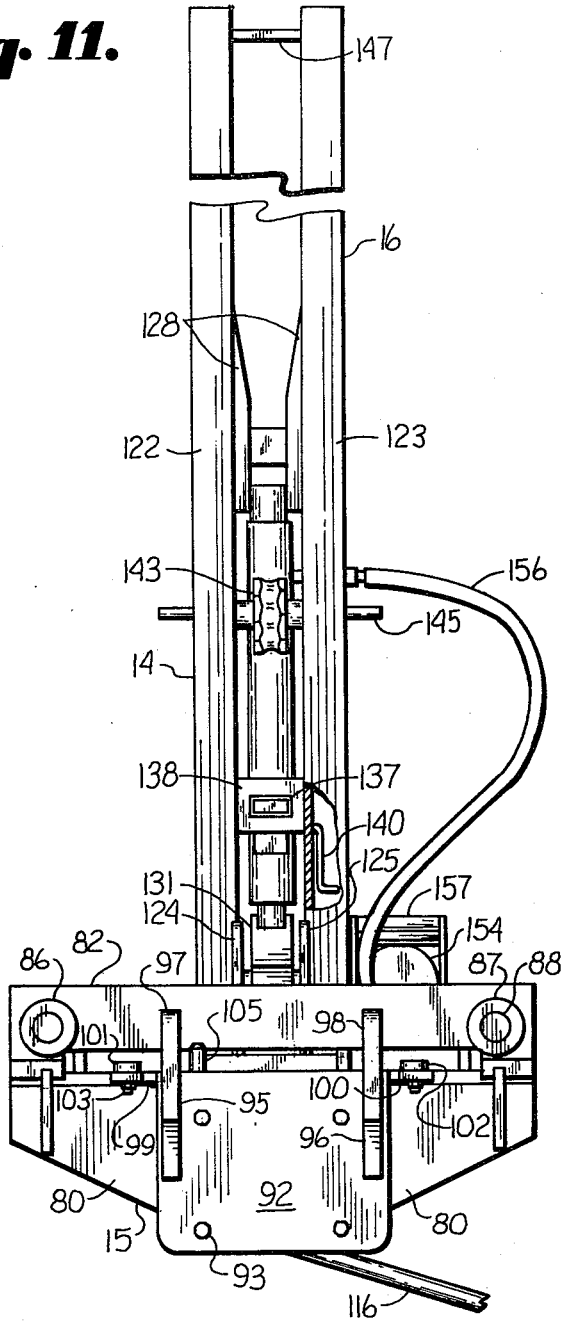
FIG. 11 is an enlarged, fragmentary view taken from the front and showing the force applying structure.

To provide anchors for various chains or other suitable tension members used with the force applying structures 14, the rack structure 2 has a plurality of receptacles 33 in the planar upper member 19, FIG. 3, and arranged in double rows thereof whereby each receptacle 33, FIG. 6, includes a bore 34 extended through the planar upper member 19 and a lower support plate 35 affixed as by welding to the lower surface of the planar upper member 19 and having a cross shaped slot 36 extending therethrough and receiving the links of a chain 37. A removable receptacle cover member 38 is insertable into the bore 34 and has a depending shank 39 fitting into a cross portion 40 of the slot 36 to prevent inadvertent disengagement of the chain links therefrom. When the chain 37 is not engaged in the receptacle 33, the cover member 38 is rotated 180 degrees from the position thereof shown in FIG. 6 so that the cover member 38 nests within the bore 34 and provides a finished appearance.

The front and rear supportive foot members 11 and 12 are affixed to the rack structure 2 to elevate the rack structure above a floor surface 13 and in the illustrated example, the rear supportive foot member 12 has means providing folding of the foot member relative to the rack structure 2 for lowering the rear end rack portion 5 to the floor surface 13 and thereby facilitating movement of the vehicle 3 onto the rack structure 2. Extended inwardly from each of the side rack portions 6 and 7 and secured to the inner web member 21 thereof are support brackets 42 each having spaced ears 43 pivotally mounted to spaced leg members 44 and 45 as by a pin 46.

A beam member 48 extends between and is connected to bottom ends of the spaced pairs of leg members 44 and 45 and to facilitate folding action, opposite ends of the beam member 48 have rollers 49 and 50 rotatably mounted thereon for translation of the rear supportive foot member 12 over the floor surface 13 during folding operations.

Figure 5:
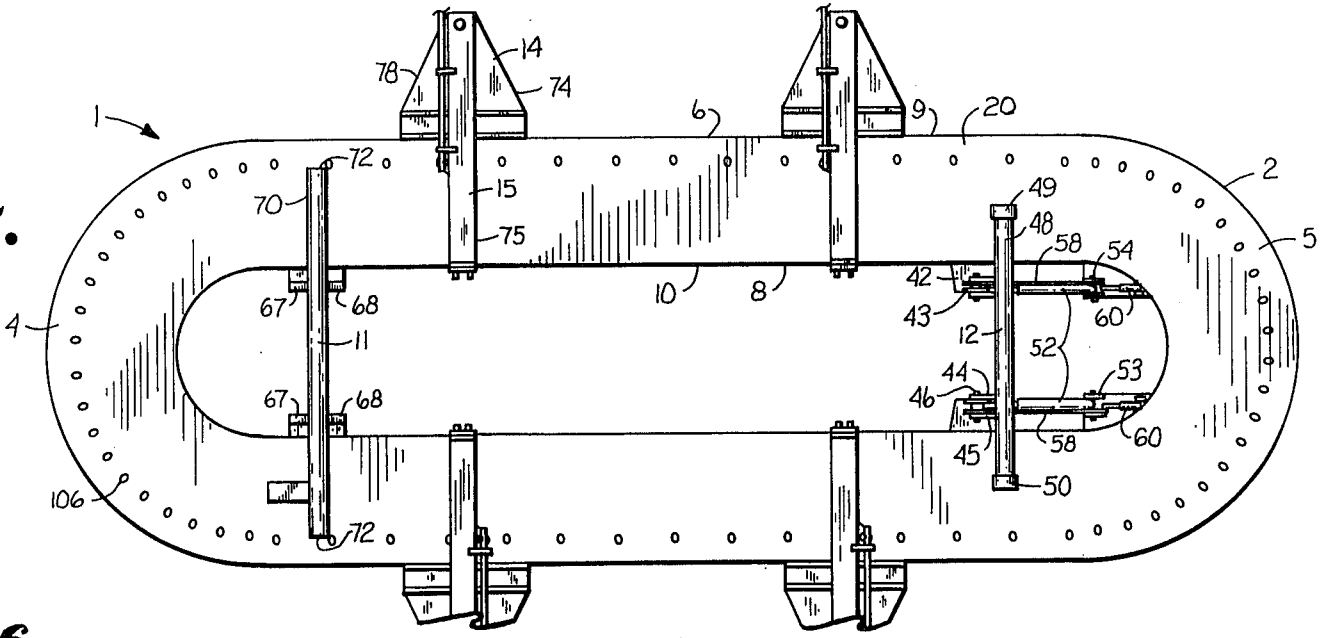
FIG. 5 is a bottom view of the vehicle work rack.

Means are included for folding the rear supportive foot member 12 whereby the rear end rack portion 5 is lowered to the floor surface 13 and in the illustrated example, the means include spaced power fluid rams 52, FIG. 5, having one end thereof pivotally connected to brackets 53 extended inwardly and downwardly from the rear end rack portions 5 and mounted thereto as by pins 54. The other end of each of the power fluid rams 52 is pivotally connected to pins 55 extending between each of the pairs of spaced leg members 44 and 45 whereby extension of the pistons of the power fluid rams 52 causes the respective pairs of leg members 44 and 45 to swing downwardly and position the rack structure 2 above the floor surface 13 and retraction of the pistons of the power fluid rams 52 swings the respective pairs of leg members 44 and 45 upwardly and toward the rear end rack portion 5 to cause the same to kneel, FIG. 2, so that the vehicle 3 can be pulled or driven thereon. Removable vehicle loading ramps 56 are positioned adjacent the outer margin 9 of the rear end rack portion 5.

Figure 4:
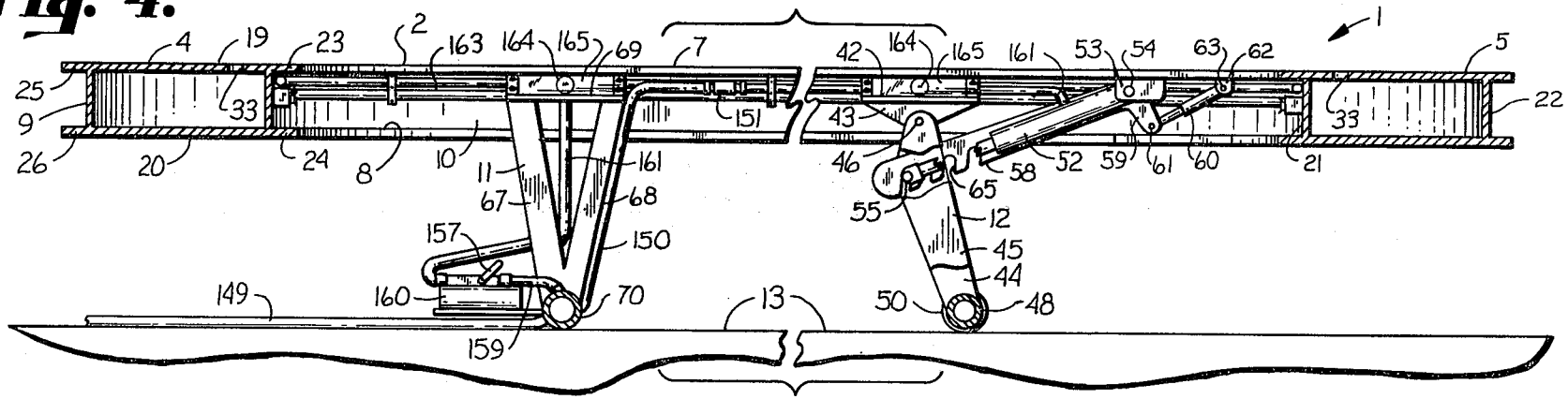
FIG. 4 is a longitudinal, sectional view of the work rack taken along lines 4—4, FIG. 3.

Safety catch arms 58 are swingably mounted adjacent the power fluid rams 52 and pivotally mounted to the brackets 53 as by the pins 54 and with bell crank portions 59 extending downwardly therefrom. Respective power fluid rams 60 each have one end thereof connected to the bell crank portions 59 as by a pin 61 and the other end thereof pivotally connected to a bracket 62 as by a pin 63. The brackets 62 are affixed to the inner margin 8 of the rear end rack portion 5 and positioned rearwardly of the brackets 53 whereby when the power fluid rams 60 are extended, the safety catch arms 58 swing upwardly and, when retracted, the arms 58 swing downwardly. Remote ends of the safety catch arms 58 include a plurality of slots 65 therein which selectively receive a pin 55. As shown for example in FIG. 4, the remote end slot 65 engages the pin 55 and prevents retractive or upwardly swinging movement of the rear supportive foot members 12, thereby removing load from the power fluid rams 52. When lowering of the rear end rack portion is desired, sequential folding operation first requires that the power fluid rams 60 extend and swing the safety catch arms 58 upwardly to disengage from the pins 55 whereby the power fluid rams 52 are retracted to swing the pairs of spaced leg members 44 and 45 upwardly and kneel the rear end rack portions 5. Should power fluid pressure fail during folding or kneeling operations, the weight of the safety catch arms 58 are no longer held in an upward, disengaged position by the rams 60 and swing downwardly from the weight thereof and one of the slots 65 thereof engage the pins 55 to prevent further downward swinging movement or sudden falling of the rear end rack portion 5 whereby injury to a worker under the work rack 1 may be prevented.

The front supportive foot member 11 is affixed to the front end rack portion 4 and depends therefrom to position the front end rack portion above the floor surface 13 and, in the illustrated example, includes pairs of spaced leg members 67 and 68 connected at upper ends thereof to brackets 69 respectively mounted inwardly of the inner margin 8 and generally at the juncture of the front end rack portion 4 with the spaced side rack portions 6 and 7. Bottom ends of the pairs of spaced leg members 67 and 68 are affixed to a transversely extending beam member 70 having an open interior 71 defining a reservoir therein for purposes described below and having opposite end caps 72 closing same.

The work rack 1 includes at least one force applying structure 14 affixed to the rack structure 2 and translatable therearound as desired to position the same for force exerting operations on the vehicle 3. In the illustrated example, the rack structure 1 has four said force applying structures 14, exemplary ones of which are shown in detail in FIGS. 7, 8, 9, 10 and 11. Each of the rack structures 14 includes the base 15 with the standard 16 upstanding therefrom and having means therein for exerting a force. The elongate base 15 extends under a rack portion 4, 5, 6 or 7 and is movably mounted thereto to provide movement of the force applying structure 14 around the rack structure 2. In the illustrated example, the base 15 includes spaced upper and lower planar members 74 and 75 secured together and in parallel relationship by web members 76 and 77. The lower planar member 75 is elongate and generally of even width and the upper planar member 74 includes an outer portion 78 of substantially triangular conformation and an inner portion 79 generally the same in conformation as the lower planar member 75. Gussets 80 extend between the outer portion 78 of the upper planar member 74 and the lower planar member 75 and are secured thereto as by welding to provide structural rigidity and strength. A vertical, longitudinally extending plate member 82 extends along the juncture of the outer portion 78 of the upper planar member 74 with the inner portion 79 thereof and has gussets 83 extending between the top surface of the outer portion 78 and the plate member 82 to provide rigidity therefor. Outer portions of the gussets 83 have inlets therein to provide overhanging arms or catches 84 which prevent upward movement of a portion of the standard 16 as described below.

Means movably mount the force applying structure 14 to the rack structure 2 and in the illustrated example, the means include base rollers 86 and 87 affixed to the plate member 82 as by a shaft 88 extending therethrough and secured by nuts 89. The rollers 86 and 87 roll on the upper surface of the outer lower flange 26 and are positioned so that the distance between the margin of the roller and the upper surface of the inner portion 79 of the upper planar member 74 is a distance greater than the thickness of the outer lower flange 26 whereby the force of gravity upon the outer portions of the force applying structure 14 tends to bring the wheels 86 and 87 in rotatative engagement with the outer lower flange 26 and a pulling force from the standard 16 to the vehicle 3, as described below, tends to swing the force applying structure 14 upwardly whereby the wheels 86 and 87 disengage from the outer lower flange 26 and the flange frictionally engages the upper surface of the inner portion 79 of the upper planar member 74.

Movably mounting an inner end 90 of the base 15 to the rack structure inner margin 8 are additional rotative means. An end plate 91 is weldably affixed to the upper and lower planar members 74 and 75 and a second end plate 92 is affixed in parallel abutment thereto as by bolts 93. Arms 95 and 96 are affixed to the plate member 94 and extend upwardly and join respective overhanging detent portions 97 and 98 which extend over the inner lower flange 24 and are engageable therewith. Gussets 99 and 100 extend horizontally and laterally from the arms 95 and 96 and have rollers 101 and 102 respectively rotatably mounted thereto, as by a shaft 103 extending therethrough and providing a horizontal direction of rotation. The rollers 101 and 102 contact the end surface 30 of the inner lower flange 24 and facilitate translation of the force applying structure 14 around the rack structure 2.

The lower margins of the overhanging detent portions 97 and 98 are spaced a distance from the top surface of the inner portion 79 of the upper planar member 74 greater than the width of the inner lower flange 24 whereby, when a pulling force is not exerted by the force applying structure 14, the base inner end 90 rides freely against the flange end surface 30 and the detent portions 97 and 98 are spaced from the upper surface of the inner lower flange 24. When a pulling force is exerted by the force applying structure 14, as described above, the base inner end 90 tends to swing downwardly and the detent portions 97 and 98 abut the inner lower flange 24 and frictionally engage therewith to maintain the base inner end 90 connected to the rack structure 2. Thus, as described above, when a pulling force is exerted by the force applying structure 14, frictional engagement occurs at the connection of the base with the inner and outer margins 8 and 9 of the rack structure 2 to prevent free translatory movement of the force applying structure 14 therearound.

Additionally, means lock the force applying structure 14 at a selected location around the rack structure 2 and, in the illustrated example, the means include an upstanding pin 105 affixed to the base 15 and selectively engageable with one of a plurality of apertures 106 in the planar lower member 20 of the rack structure 2. An elongate, horizontal rod 107 is supported longitudinally of and under the lower planar member 75 by spaced hangers 108 and 109 and a lever arm 110 projects laterally from one end of the rod 107 and is pivotally connected to a lower end 111 of the rod 105. A coil spring 112 is sleeved on the pin 105 between the upper and lower planar members 74 and 75 and between flange members 113 and 114 secured to the pin 105 whereby the resilient action of the coil spring 112 tends to force a chamfered upper end 115 of the pin 105 upwardly and through a selected one of the apertures 106. An elongate handle portion 116 is joined to the rod 107 and projects generally laterally therefrom whereby when the handle 16 is grasped and pulled upwardly, the lever arm 110 swings downwardly and pulls the pin 105 downwardly therewith, thereby withdrawing the pin upper end 105 from the aperture 106 and permitting translational movement of the force applying structure 14 on the rack structure 2. Release of the upward pulling force on the handle 116 causes the coil spring 112 to resiliently extend and push the upper end 105 upwardly and into a selected aperture 106, thereby locking the force applying structure 14 at a selected location around the rack structure 2.

The standard 16 is mounted generally on the base 15 and, in the illustrated example, means provide pivotal movement between the standard 16 and the base 15. A horizontal plate member 118 is positioned upon the outer portion 78 of the base upper planar member 74 and is pivotally connected thereo at an outer end portion by a pin 119 extending generally vertically through the plate member 118 and the upper and lower planar members 74 and 75 and secured at opposite ends as by nuts 120.

The standard 16 includes a pair of laterally spaced parallel posts 122 and 123 tapered upwardly and secured at bottom ends thereof to the plate member 118 for pivotal movement therewith. Leg portions 124 and 125 extend toward the rack structure 2 from the lower portions of the posts 122 and are also affixed to the plate member 118. In the illustrated example, each force applying structure 14 has an extensible member, such as a power fluid ram 127, with one end thereof pivotally connected to brackets 128 as by a pin 129. The other end of the power fluid ram 127 is pivotally connected, as by a pin 130, to a bell crank or leverage arm 131 which is pivotally mounted by a pin 132 to extreme ends of the leg portions 124 and 125 and at a point spaced from the respective end of the power fluid ram 127. A spring 133 connected to the leverage arm 131 biases the arm 131 to an upward position. The leverage arm 131 has an aperture adjacent the connection thereof with the power fluid ram 127 and has holding means therein such as a detent or dog 134 having a sloping, bifurcated end defining a slot sized to receive one line of a tension member such as a chain 135. The detent or dog 134 has a sloping surface toward the posts 122 and 123 and the opening thereof is open also toward the posts 122 and 123. Spaced upwardly from the detent or dog 134 is a second detent or dog 137 slidably positioned in spaced guides 138. A lever assembly 139 with handle 140 operatively connected thereto causes the detent or dog 137 to move inwardly and outwardly through the guides 138. The detent or dog 137, like the detent or dog 134, has a bifurcated or slotted end portion to catch and receive links of the chain 135 therein.

At least one, and in the illustrated example, two guide members 143 are positioned between the posts 122 and 123 upwardly of the leverage arm 131. The exemplary guide members 143 are sprockets that have an outer rim with a series of cusps and depressions which receive and engage the links of the chain 135 to substantially prevent slippage thereof during exertion of pulling force.

In the illustrated example, the guide members 143 are movably mounted in the standard 16 for height adjustment and to change the angle of pull of the chain 135. The posts 122 and 123 include a plurality of bores 144 in alignment with pins 145 therethrough which project laterally a distance beyond the margins of the posts 122 and 123 whereby the pins 145 may be easily grasped and removed to reposition the guide members 143 relative to selected bores 144 as desired.

To provide rigidity at the upper portion of the posts 122 and 123, a U-shaped spacer is secured thereto, as by welding, that retains the upper ends of the posts 122 and 123 in spaced relationship for mounting of the guide member 143.

To effect a pulling force, power fluid is directed to an extension port of the power fluid ram 127 whereby the leverage arm 131 is forcibly swung downwardly and the chain 135 caught in the detent or dog 134 and pulled downwardly therewith. The chain 135 is pulled around the guide member 143 to exert a pulling force on the portion of the vehicle 3 to which the chain is connected. The leverage arm 131 can swing downwardly only a relatively short distance before the power fluid ram 127 reaches full extension. To maintain tension on the chain 135 as the power fluid ram 127 is recycled from an extended position to a retracted position in order to make a second pull on the chain, the detent or dog 137 may be manually extended by the handle 140 to engage the chain 135 and hold same while the leverage arm 131 is moved upwardly and until the detent or dog 134 again engages the chain. Alternatively, the upper detent or dog 137 may be maintained in an extended position and the sloping, bifurcated ends of both the detent or dog 134 and the detent or dog 137 permit the dog 137 to be maintained in an extended position and, when the chain 135 is moved downwardly, as for a pull, the links of the chain 135 tend to slide downwardly and over the sloping surfaces of the bifurcated end. In contrast, when pulling force upon the chain 135 is substantially reduced and movement thereof ceases, the links of the chain 135 engage with the detent or dog 137 and tension is maintained on the chain to prevent resilient rebounding of frame or body parts upon which work is being performed. Accordingly, the sloping, bifurcated end of the detent or dog 137 on the leverage arm 131 permit the leverage arm 131 to be swung upwardly during retraction of the power fluid ram 127 and the links of the chain will not engage with the detent or dog 137 but merely slide off the bifurcated end portion until downwardly the leverage arm 131 begins to swing again, at which time the links of the chain engage with the detent or dog 135 and a downward or pulling force on the chain 135 may be accomplished.

Means for providing power fluid to the various power fluid rams are included with the work rack 1 and, in the illustrated example, the power fluid rams are powered by hydraulic oil under pressure and routed from pumps driven by compressed air. A primary air line 149 extends from a suitable source of pressurized air, such as an air compressor (not shown) as is commonly available in garages, work shops and the like, and is connected via a fitting to the beam member 70 wherein the open interior 71 thereof defines a reservoir. The reservoir holds a quantity of the pressurized air and the beam member 70 may have drain valves or the like to provide for outflow of any water condensing within the reservoir. From the beam member 70, an air distribution line 150 is routed about the interior opening 10 of the rack structure 2 and, at intervals therealong, has Tee fittings 151 routing pressurized air via conduits to a plurality of quick disconnect fittings 152 located at about the perimeter of the outer margin 9.

Mounted on the horizontal plate portion 118 of each of the force applying structures 14 is a pump means 154 connected to the air distribution line 150 through a distribution line 153. A distribution line 156 extends from the pump means 154 to the power fluid ram 127 of the respective force supplying means 14. Appropriate valve means, such as a valve having a foot plate 157 therewith to effect operation of the valve, is operatively connected to the pump means 154 and routes hydraulic oil under pressure to the power fluid ram 127 for operation thereof. In the illustrated example, the power fluid ram 127 is a single acting ram and the hydraulic oil causes extension of the ram and downward swinging of the leverage arm 131. The spring 133 within the leverage arm 131 causes the leverage arm to resiliently swing upwardly when downward forces, as from the ram 127, is released. The pump means 154 contains an internal motor (not shown) utilizing the compressed air from the distribution line 153 to drive an internal pump (not shown) providing hydraulic oil under pressure to actuate the ram 127. During movement of the force applying structures 14 around the rack structure 2, the distribution lines 153 can be disconnected and reconnected as desired to available quick disconnect fittings 122 more closely spaced to the position of the force applying structure 14 for applying a force from a selected location.

To effect kneeling action of the rack structure 2, the distribution line 159 extends from the reservoir and the beam member 70 and to a pump means 160 that functions as described above in connection with the pump means 154. Distribution lines 161 connect the pump means 160 with the power fluid rams 52 and 60 to control raising and lowering of the rear end rack portion 5, as described above.

The work rack 1 may include lighting means for illuminification of the underside of the vehicle 3 and in the illustrated example, electrical lines 163 are routed to the spaced support brackets 42 and 69 and operatively connected to light bulb members 164 mounted therein and protected by transparent covers 165, such as of Plexiglas and the like, which are mounted in overlying relation to the brackets 42 and 69.

In the operation of the work rack 1, a vehicle 3 must be positioned on the rack structure 2. A workman steps upon the foot plate 157 of the pump means 160 and actuates the power fluid rams 60 to raise the safety catch arms 58 and allow hydraulic oil to escape through the appropriate distribution lines from the spaced power fluid rams 52 and thereby cause the rear supportive foot members 12 to fold relative to the rack structure until the rear end rack portion 5 contacts the floor surface 13. The removable ramps 56 are positioned adjacent the rear end rack portion 5 and the vehicle 3, if movable under its own power, is driven onto the rack structure 2.

Figure 2:
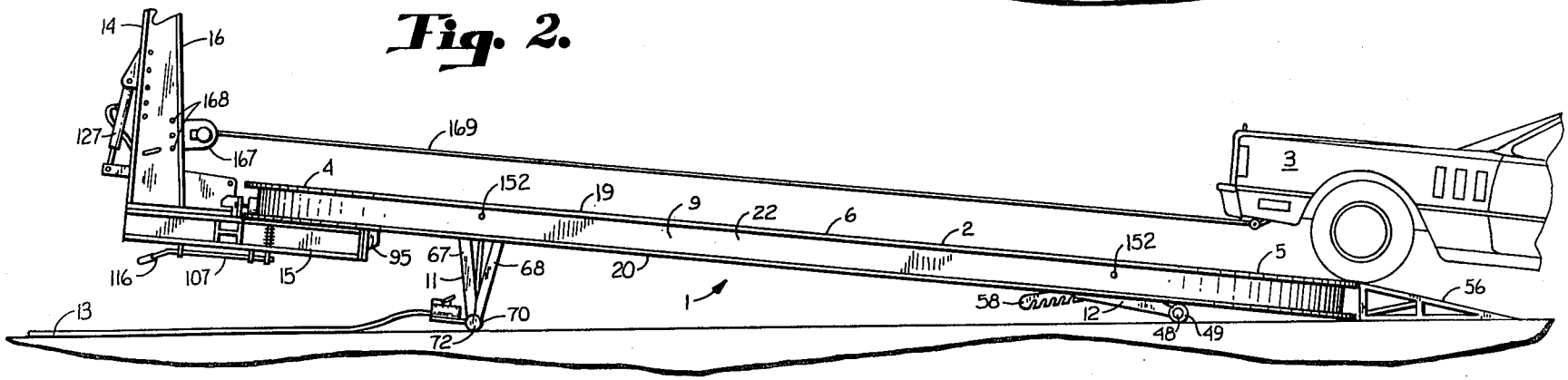
FIG. 2 is an elevational view of the work rack and showing one end thereof lowered to facilitate positioning a vehicle thereon.

If the vehicle 3 is not motive under its own power, a winch 167, FIG. 2, is removably attached to a front side of the standard 16 as by pins 168 and a cable 169 or the like is unreeled from the winch 167 and attached to the vehicle 3 to pull the vehicle onto the rack structure 2. The winch 167 preferably has appropriate electrical lines (not shown) for connection to a suitable source of electrical power.

After the vehicle 3 has been positioned on the rack structure 2 and the work rack 1 raised from the kneeling position, the force applying structures 14 are positioned as necessary around the outer margin 9 of the rack structure 2 in order to exert a force on a desired portion of the frame or body of the vehicle. To move the force applying structures 14, the handle portion 116 is grasped and pulled upwardly to withdraw the pin 105 from an aperture 106 and, holding the handle portion 116 in an upward position, the force applying structure 14 is pulled or pushed laterally around the outer margin 9. To permit movement of the base 15 relative to the rack structure 2, the downward weight of the standard 16 on the outer end of the force applying structure 14 pulls the rollers 86 and 87 into rotative contact with the surface of the outer lower flange 26 and lifts the overhanging detent portions 97 and 98 of the arms 95 and 96 from contact with the upper surface of the inner lower flange 24, thereby permitting the inner end 90 to move freely by contact of the rollers 101 and 102 with the end surface 30. After positioning the force applying structure 14 at a selected location around the rack structure 2, the handle 116 is released and the pin 105 again engages a selected aperture 106. Should the force applying structure 14 not be positioned precisely so that the pin 105 aligns with an aperture 106, the force applying structure 14 is moved laterally either direction until the pin 105 is received in an aperture 106.

An end of the chain 135 is attached to an appropriate tool or the like and attached to a vehicle frame or body portion to effect a pulling movement thereon. Prior to exerting the pulling force, opposite portions of the vehicle should be secured against movement, as by chaining to selected receptacles 33, FIGS. 13 and 14. The pump means 154 is actuated and the power fluid ram 127 extends to swing the leverage arm 131 downwardly and thereby exert a pulling force on the chain 135. During application of the pulling force, the standard 16 tends to rotate upwardly in the direction of the pull and disengages the rollers 86 and 87 from the upper surface of the outer lower flange 26 and frictionally engage the inner portion 79 of the upper planar member 74 with the planar lower member 20 and swing the overhanging detent portions 97 and 98 of the arms 95 and 96 into contact with the upper surface of the inner lower flange 24, thereby preventing free movement of the force applying structure 14 around the outer margin 9. As pulling force is applied by the chain 135, the standard 16 tends to pivot about a vertical axis and become aligned in the direction of pull, FIG. 3. The horizontal plate member 118, with the posts 122 and 123 thereon, swings about the pin 119 in the direction of pull. To prevent a forward or inner end portion of the horizontal plate member 118 from excessive movement upwardly, the overhanging arms or catches of the spaced gussets 83 and 85 engage the horizontal plate member 18 as the end portion thereof swings upwardly and prevents further upward movement. As shown in FIG. 3, the gussets 83 and 85 are arranged to provide approximately 50 degrees of movement in a horizontal plane and not interfere with the horizontal swinging movement of the plate member 118 through the 50 degrees of movement.

Figure 12:
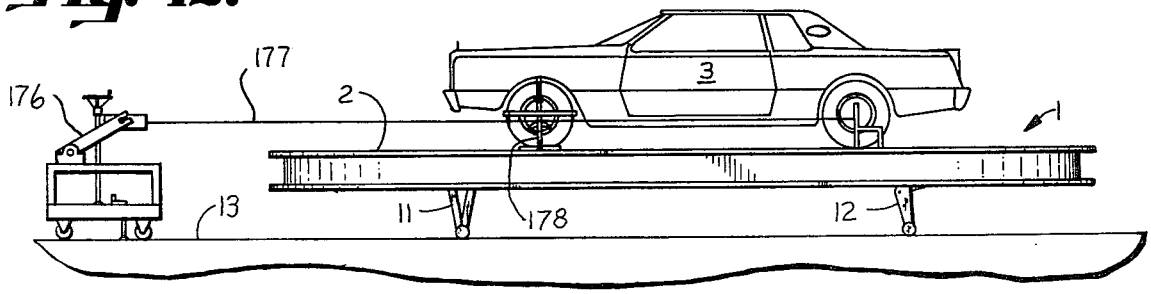
FIG. 12 is a side elevational view showing the vehicle work rack used in conjunction with a wheel alignment apparatus.

The rack structure 2 may be employed for purposes not only involving frame or body straightening and, in the example thereof shown in FIG. 12, a line of sight alignment apparatus 176 is positioned in longitudinal alignment with the vehicle 3 and used to project a line of sight 177 at selected target structures 178 mounted to the vehicle wheels and thereby indicate front end steering and suspension measurements.

Figure 13:
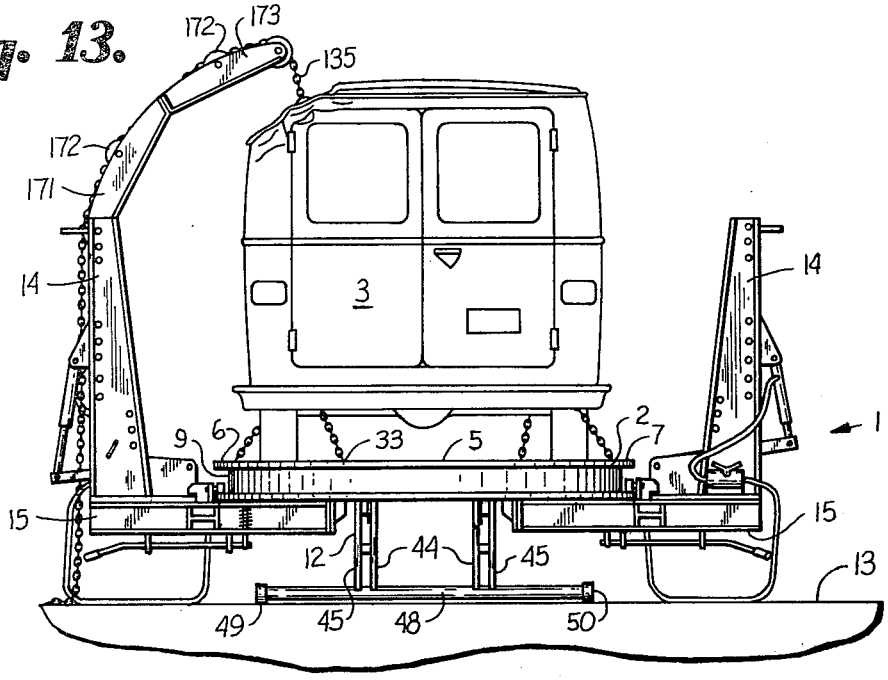
FIG. 13 is an end elevational view showing the vehicle work rack and force applying structures used to exert a pull upon a damaged roof section of a vehicle.

Different directions and types of applications of force may be exerted by the force applying structures 114 and as shown in FIG. 13, extensions are connected to the top of the standard 16 so that the chain 135 can be routed therethrough to provide a substantially upward pulling force. A first extension member 171 is removably mounted to the posts 122 and 123 as by pinning and contains a guide member 173 therewith. A second extension member 173 is removably mounted to a remote end of the first extension member 171, as by pinning and likewise includes a guide member 172 whereby the chain 135 is routed upwardly from the standard 16 and through the first and second extension members 171 and 173 whereby an upward pulling force is achieved. This application is particularly useful for removing roof damage from vehicle rollovers and the like.

Figure 14:
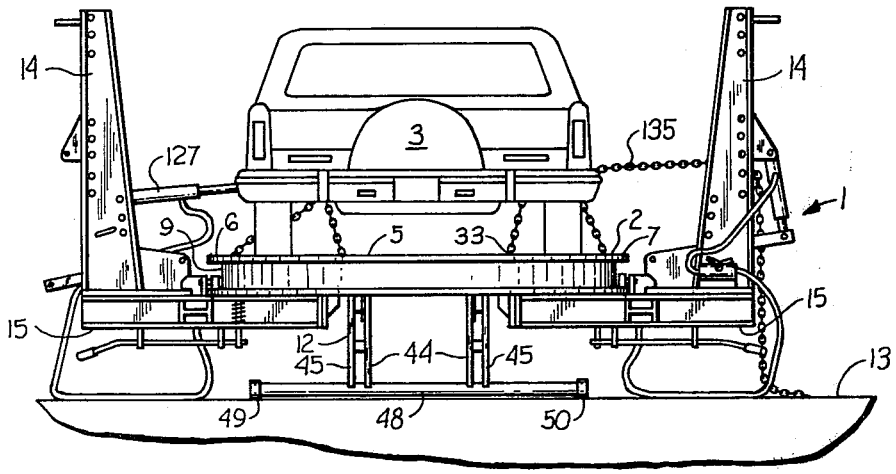
FIG. 14 is an end elevational view of the work rack and force applying structures, one of which is exerting a pull on the vehicle and another of which is exerting a push on the vehicle.

Yet another exemplary application is disclosed in connection with FIG. 14 whereby a pushing force is applied from a left side force applying structure 14. In this application, the power fluid ram 127 is detached from the position thereof shown in connection with FIGS. 8, 10 and 11 and mounted, as by pinning, to a front portion between the posts 122 and 123. Preferably, a tool or engagement device is fitted onto the extensible end of the ram 127 and extension thereof causes a pushing force against a selected portion of the vehicle frame or body.

Figure 15:
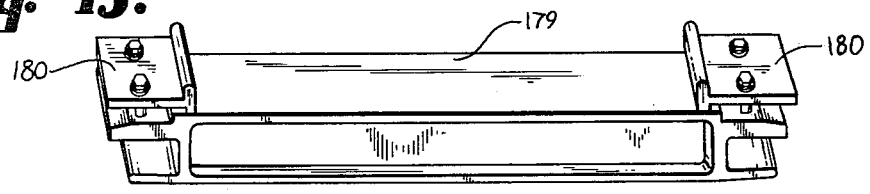
FIG. 15 is a perspective view of a cross beam member which may be mounted across the work rack.

During many work situations utilizing the work rack 1, is it preferred that the interior opening 10 of the rack structure 2 remain open so that a workman may have unhindered access to an underside of the vehicle 3. In some circumstances, it is desirable to apply a pushing force, for example, to frame or body members of the vehicle underside which are not spaced above the supportive surface of the rack structure 2 but instead located generally over the interior opening 10. For this purpose, a removable crossbeam 179, FIG. 15, is provided which has opposite ends 180 thereof provided with clamping means and engageable with opposite upper flanges 23 of the inner margin 8 so that the crossbeam 179 extends transversely across the opening 10 and is translatable or movable therein relative to the longitudinal axis of the rack structure 2 for providing a supportive surface on which a portable ram for example, (not shown) can be positioned and a force applied to selected members of the vehicle undercarriage.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A work rack for correcting misshapen vehicle frame and body portions comprising:

(a) a rack structure having a vehicle supportive upper surface and with generally continuous front end, rear end and opposite side rack portions having an outer perimeter margin and an inner margin, the inner margin forming an interior opening whereby a vehicle straddles said opening for work access to the vehicle underside;

(b) front and rear supportive foot members affixed to said rack structure for positioning said rack structure above a floor surface;

(c) at least one force applying structure having an elongate base extending under one of said rack portions and under said supportive upper surface and having outer and inner rollers secured to said base and respectively engaging said outer and inner rack margins and mounting said base to said rack structure for selectively free translation around said rack structure to a position for exerting a force on a selected area of said vehicle;

(d) said elongate base being substantially slung from said rack structure by said rollers and shiftable upwardly and downwardly relative thereto at selective locations around said rack structure upon application of force from said force applying structure;

(e) said force applying structure including a standard mounted on said base, upstanding therefrom and positioned outwardly of the rack structure outer margin; and a force applying means mounted on said force applying structure for operative connection to the vehicle to exert a force thereon and correct misshapen frame and body portions; said force applying means upon exerting a tensioning force on said vehicle, causing said force applying structure to swing slightly toward said vehicle and tilt said base to disengage said outer rollers from said outer rack margin and means mounted on said base for abutting said rack structure and for frictionally locking said force applying structure at a selective location around said rack structure upon tilting of said base.

2. The work rack set forth in claim 1 wherein:

(a) said rack structure has planar upper and lower surface members forming an elongate, oval shape and said inner and outer margins have flanges extending outwardly of said surface members and inwardly thereof toward said interior opening; and (b) said interior opening is centrally located with respect to said front, rear and opposite side portions.

3. The work rack set forth in claim 6 wherein:

(a) said upper and lower surface members are secured together by spaced inner and outer web members and said flanges respectively extend from said lower surface member;

(b) the flanges on said inner and outer margins respectively have end surfaces and top surfaces;

(c) said outer rollers have roller mounts secured to said base and extending upwardly and over said outer margin flange and positioning said rollers for normal engagement with the top surface of said outer margin flange; and said inner rollers have roller mounts secured to said base and positioning said rollers in contact with the end surface of said inner margin flange, said base having an arm extending upwardly therefrom and over said inner margin flange and normally in disengaged relation thereto whereby, when a pulling force is exerted by said force applying means to a vehicle on said rack structure, said base swings relative to said lower surface member and disengages the outer rollers from the top surface of said outer margin flange and engages said arm with the top surface of said inner margin flange, thereby frictionally locking said force applying structure in a selected position on said rack structure.

4. The work rack set forth in claim 1 wherein:

(a) said force applying structure includes:

(i) an extensible member having one end thereof pivotally connected to a fixed point relative to said base;

(ii) a flexible member adapted to be connected to a vehicle to receive a pulling force;

(iii) means actuated by said extensible member and having a portion engaging said flexible member to apply a pulling force thereto in response to extension of said extensible member;

(iv) means mounted on said standard above said pulling force applying means for guiding said flexible member into engagement therewith; and (v) means mounted on said standard and engageable with said flexible member to hold same against retractive movement upon contraction of said extensible member and to permit said flexible member to move in one direction and limit movement in the opposite direction.

5. A vehicle work rack comprising:

(a) supportive rack structure having a planar upper and lower surface members forming an elongate, oval shape with respective inner and outer edges and having a central opening for supporting vehicle on said upper surface member straddling said central opening for access to the underside of said vehicle;

(b) spaced, inner and outer web members extending between and secured to said upper and lower surface members and spaced from said inner and outer edges to provide upper, lower, inner and outer flanges extending around said rack structure, said inner upper and lower flanges bounding said central opening;

(c) a front support affixed to rack structure and having a floor engaging, laterally extending front foot member and spaced front leg members respectively secured at bottom ends thereof to said foot member and at upper ends thereof to said rack structure for supporting said rack structure above the floor;

(d) a rear support affixed to said rack structure and having a laterally extending rear foot member with floor engaging rollers thereon and spaced rear leg members respectively secured at bottom ends thereof to said rear foot member and swingably mounted at the upper ends thereof to said rack structure;

(e) a linkage arrangement and power fluid rams operatively connected between said rear leg members and said rack structure and operable to fold said rear leg members relative to said rack structure and kneel said rack structure over said rear support;

(f) a plurality of force applying structures movably positioned around the outside perimeter of said rack structure and able to selectively travel completely therearound, each of said force applying structures having a generally horizontal elongate base affixed to a lower portion thereof and extending under said rack structure toward said central opening; said base having means generally rotatably engaging said outer, lower flanges and said inner and lower flanges for translatory movement of each of said force applying structures around said rack structure;

(g) said force applying structures respectively including a standard mounted on said base and upstanding therefrom, an extensible member having one end thereof for operative connection to a vehicle situated on said rack structure to apply a force thereto.

6. A work rack for correcting misshapen vehicle frame and body portions comprising:

(a) a rack structure having a vehicle supportive upper surface;

(b) front and rear supportive foot members affixed to said rack structure for positioning said rack structure above a floor surface, said rear supportive foot members being swingably connected to said rack structure;

(c) a first power ram extending between said rear supportive foot members and said rack structure and operable to draw said rear supportive foot members upwardly and kneel said rack structure upon said floor surface;

(d) a lug protruding from at least one of said rear supportive foot members;

(e) an arm member pivotally mounted at one end to said rack structure adjacent said rear supportive foot members and having a plurality of slots at the other end thereof individually engageable with said lug;

(f) a second power ram operatively connected in conjunction with said first power ram and to the one end of said arm member with a bell crank mechanism therebetween and operable upon application of power to swing said arm upwardly in disengaged relation from said lug and permitting said rear supportive foot members to be folded; said second power ram, upon disruption of power thereto, removing upward swinging force from said arm to cause said arm to swing downwardly and capture said lug in one of said slots as a safety catch to prevent inadvertant folding;

(g) at least one force applying structure having means movably mounting said force applying structure to said rack structure and providing translatory movement thereabout whereby a force is exerted on a selected area of said vehicle; and (h) means for affixing said force applying structure at a selected location about said rack structure.

7. A work rack for correcting misshapen vehicle frame and body portions comprising:

(a) a rack structure having a vehicle supportive upper surface, a lower surface member and with generally continuous front end, rear end and opposite side rack portions having inner and outer margins and joined together to form an interior opening centrally located with respect to said front, rear and opposite side portions, said rack structure forming an elongate, oval shape and being adapted to support a vehicle in straddling relationship over said central opening;

(b) front and rear supportive foot members affixed to said rack structure for positioning said rack structure above a floor surface;

(c) said rack structure lower surface member having an inner and an outer flange extending respectively inwardly and outwardly therefrom from said inner and outer margins;

(d) each of said flanges having an end surface and a top surface; and (e) at least one force applying structure including:

(1) an elongate base extending generally under said rack structure;

(2) a standard mounted on said base and upstanding therefrom;

(3) a force applying means mounted on said standard for operative connection to the vehicle to exert a force thereon and correct misshapened frame and body portions;

(f) an outer roller mounted on said base and positioned over said outer flange for normal engagement with said outer flange top surface;

(g) an inner roller mounted on said base and positioned in contact with said inner flange end surface; and (h) an arm mounted on said base and extending upwardly therefrom and over said inner flange upper surface and normally in disengaged relation with respect to said inner flange upper surface;

(i) said base swinging relative to said lower surface member, disengaging said outer roller from said outer flange top surface and engaging said arm with said top surface of said inner flange when a pulling force is exerted by said force applying means to a vehicle on said rack structure, thereby frictionally locking said force applying structure in a selected position on said rack structure.

* * * * *